US005558223A

United States Patent [19]

Stefanescu

[11] Patent Number: 5,558,223

[45] Date of Patent: Sep. 24, 1996

[54] PACKING FOR PAPER ROLLS

[75] Inventor: Michael Stefanescu, Berlin, Germany

[73] Assignee: Herlitz Aktiengesellschaft, Berlin, Germany

[21] Appl. No.: 397,272

[22] PCT Filed: Apr. 20, 1993

[86] PCT No.: PCT/EP93/00946

§ 371 Date: Mar. 15, 1995

§ 102(e) Date: Mar. 15, 1995

[87] PCT Pub. No.: WO94/07762

PCT Pub. Date: Apr. 14, 1994

[30] Foreign Application Priority Data

Oct. 6, 1992 [DE] Germany ..... 92 13 430 U

[51] Int. Cl.[6] ..... B65D 85/66; B65D 85/675; B65H 18/28

[52] U.S. Cl. ..... 206/389; 206/410; 242/160.1

[58] Field of Search ..... 206/410, 389; 229/87.05, 87.19; 383/205, 207, 209; 242/160.1

[56] References Cited

U.S. PATENT DOCUMENTS

| | | | |
|---|---|---|---|
| 1,943,538 | 1/1934 | Kahn | 206/410 X |
| 2,510,120 | 6/1950 | Leander . | |
| 3,231,949 | 2/1966 | Phipps . | |
| 3,691,140 | 9/1972 | Silver | 260/78.5 |
| 5,181,364 | 1/1993 | Weder | 53/397 |
| 5,318,656 | 6/1994 | Dylla et al. | 206/389 X |

FOREIGN PATENT DOCUMENTS

| | | | |
|---|---|---|---|
| 374396 | 1/1930 | Belgium . | |
| 1123254 | 9/1956 | France . | |
| 372262 | 10/1930 | United Kingdom | 206/389 |
| 704397 | 6/1952 | United Kingdom . | |
| 766521 | 1/1957 | United Kingdom | 206/410 |

*Primary Examiner*—B. Dayoan
*Attorney, Agent, or Firm*—Friedrich Kueffner

[57] ABSTRACT

In order to package paper, such as gift-wrapping, packaging, shelf-lining and book-binding paper in the form of rolls in such a way that the packaging envelope itself is formed by the paper, the paper roll (10) is provided with an opening aid (20) disposed in one of the outermost paper layers (13), such as a tearing tab (21), tearing thread or the like. The paper roll possesses a paper strip leader (11) following the opening aid (20) in the form of a packaging envelope within the external terminal paper area (12), in which case the opening aid (20), which is expediently caused to issue from one of the two paper roll ends with a gripping section (22), is disposed in or on that paper layer (13) which is covered by the external paper layer (14), whose free end (14*a*) is glued together with the subjacent paper layer (13) (FIG. 5).

12 Claims, 3 Drawing Sheets

PACKING FOR PAPER ROLLS

FIELD OF THE INVENTION

The present invention relates to a package for paper, such as gift wrapping paper, packaging paper, shelf-lining paper and book-binding paper in the form of rolls.

DESCRIPTION OF THE RELATED ART

Gift wrapping paper, packaging paper, shelf-lining paper and book-binding paper is offered in the form of rolls. In order to maintain the paper in the form of rolls, the paper rolls are provided with a circumferential paper band or film band and are then additionally packaged in a foil. In numerous cases, shrink film is used as packaging film. This type of package is uneconomical, particularly since the package, too, has to be disposed of as waste.

SUMMARY OF THE INVENTION

The technical problem of the present invention is to provide a sales package for paper, such as gift wrapping paper, packaging paper, shelf-lining paper and book-binding paper in the form of rolls, in which the product, in this case the paper, constitutes the packaging covering itself for the actual paper to be used so that an ecologically friendly, economical package is obtained.

In the package for rolls of paper of the most widely varying types constructed according to the invention, the paper roll is designed in the form of a sales package and is provided with an opening aid disposed in the outermost paper layer, such as a tearing strip, tearing tab or the like, wherein a paper strip leader which follows the opening aid is provided that acts as a packaging envelope within the external paper end area. The opening aid, which is expediently provided with a gripping section and is caused to issue from one of the two ends of the paper roll, is disposed in or on the paper layer which is covered by the external layer of paper, whose free end is glued together with the subjacent paper layer.

Due to the circumstance that the opening aid, e.g. in the form of a tearing tab, is disposed in the second paper layer, when the opening aid is pulled off in the longitudinal direction of the paper roll, the packaging envelope ensheathing the actual paper roll is separated from the actual paper. This packaging envelope constitutes at the same time the paper strip leader because the free end of the outermost paper layer of the paper roll is glued together with the subjacent paper layer so that, when the opening aid is torn open, tearing or separating edges are produced in each case in two of the paper layers so that then, when the opening aid is separated from the paper, a tearing or separating edge is formed in the second paper layer which, at the same time, constitutes the beginning of the paper to be used of the paper roll. Since the paper strip leader, which represents the actual packaging envelope, in its length, is dimensioned so as to be somewhat greater than the circumference of the paper roll, no substantial loss of paper ensues. In the case of a roll diameter of, by way of example, 32 mm, a blank area having a length of approximately 130 mm is apportioned to the paper strip leader, in which case the blank area resulting from the opening aid being pulled off is approximately 100 mm, while 30 mm of a blank area are glued together with the first-mentioned blank area over a length of 100 mm.

Since the packaging envelope itself is comprised of the paper formed into a roll, any additional packaging is unnecessary; during the production of the paper roll, the packaging envelope is fabricated along with the same subsequent to the opening aid having been inserted and firmly joined to the second paper layer. According to this the package is economical, the packaging envelope obtained can be supplied to the recycling and, since it is in the form of paper, is thus reusable.

BRIEF DESCRIPTION OF THE DRAWINGS

Embodiment examples of the invention are depicted in the drawings. Thus

DETAILED DESCRIPTION OF THE INVENTION

Figure 1:
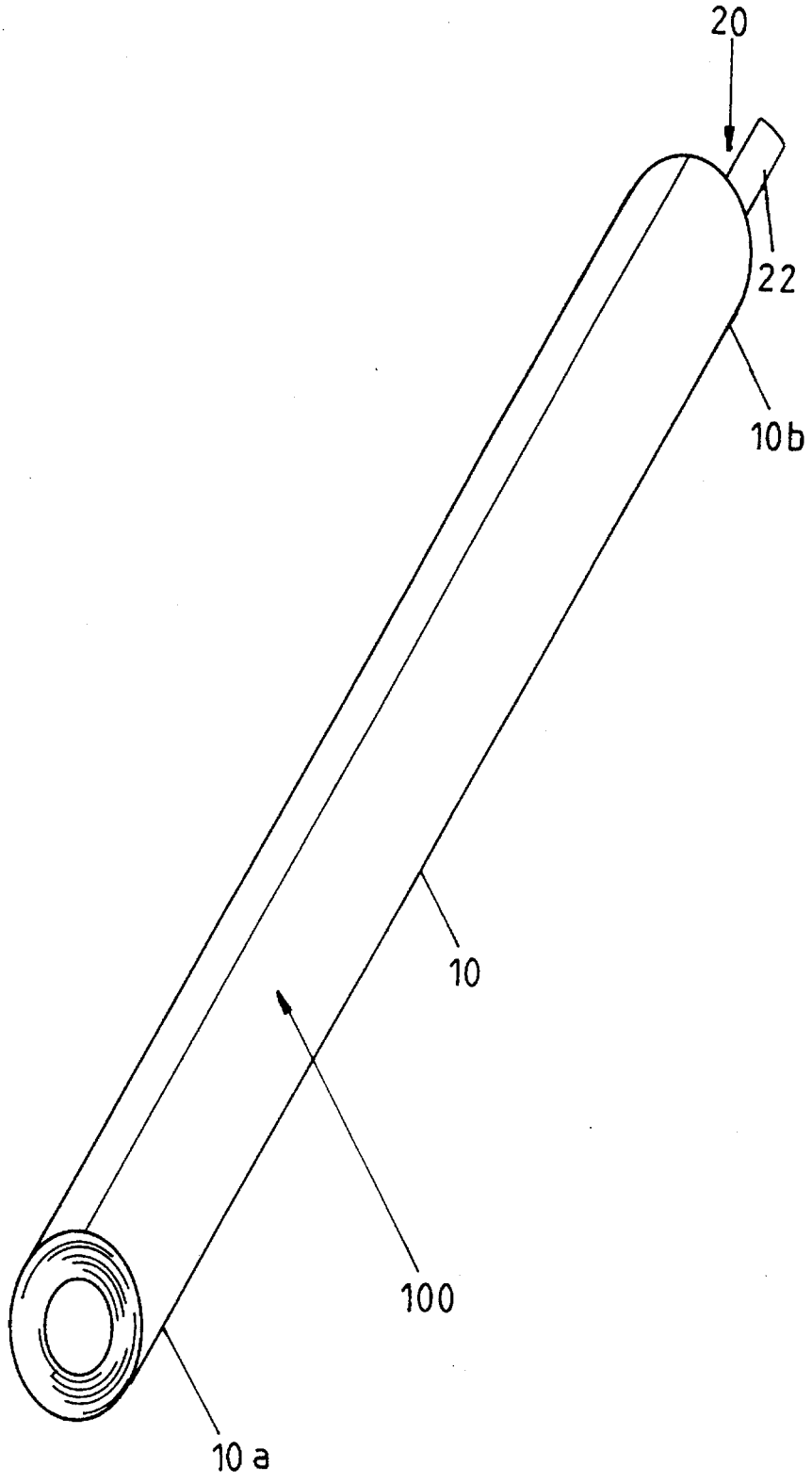
FIG. 1, in a diagrammatical representation, shows a paper roll with an inserted opening aid in the form of a tearing tab.

The paper roll 10 depicted in FIG. 1 is constructed in the form of a sales package 100. This sales package 100 comprise every type of paper, such as gift-wrapping paper, packaging paper, shelf-lining paper and book-binding paper in the form of rolls; in the case of the gift-wrapping paper, packaging paper, shelf-lining and book-binding paper, relatively thin types of paper are involved, which may have coloured patterns printed on them or may be plain, i.e. devoid of any patterns printed on them. The two ends of the paper roll 10 are identified with 10*a*,10*b* (FIG. 1).

The paper roll 10 is provided with an opening aid 20 proceeding in the longitudinal direction of the paper roll and attached to one of the outermost paper layers 13 which, in the depicted embodiment example in the FIGS. 1 to 6 is contructed in the form of a tearing tab 21. This opening aid 20 or the tearing tab 21 is comprised of a strip-like blank of cardboard, pasteboard or of some other suitable, tearproof material.

Figure 2:
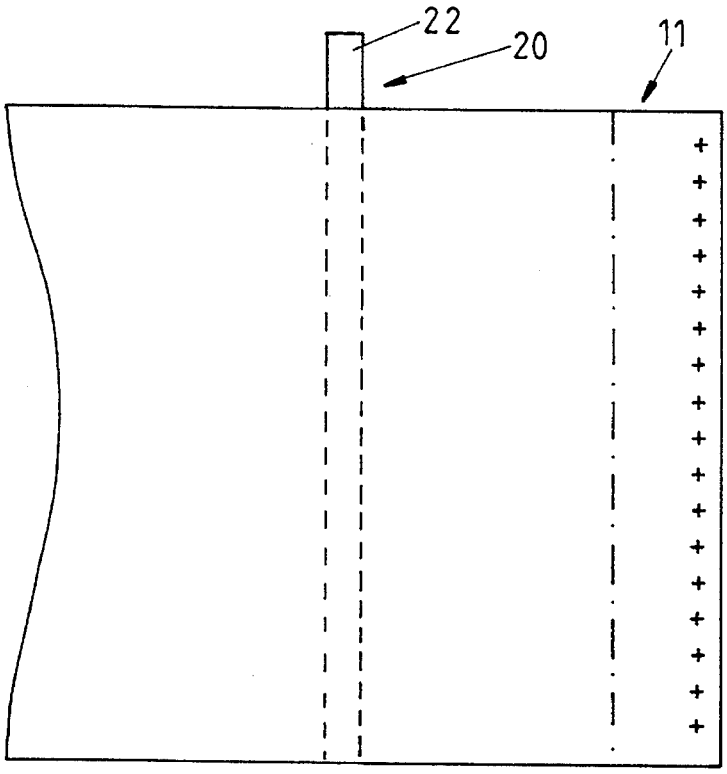
FIG. 2, in a view from above, shows the terminal area with the opening aid of the unrolled paper.
Figure 3:
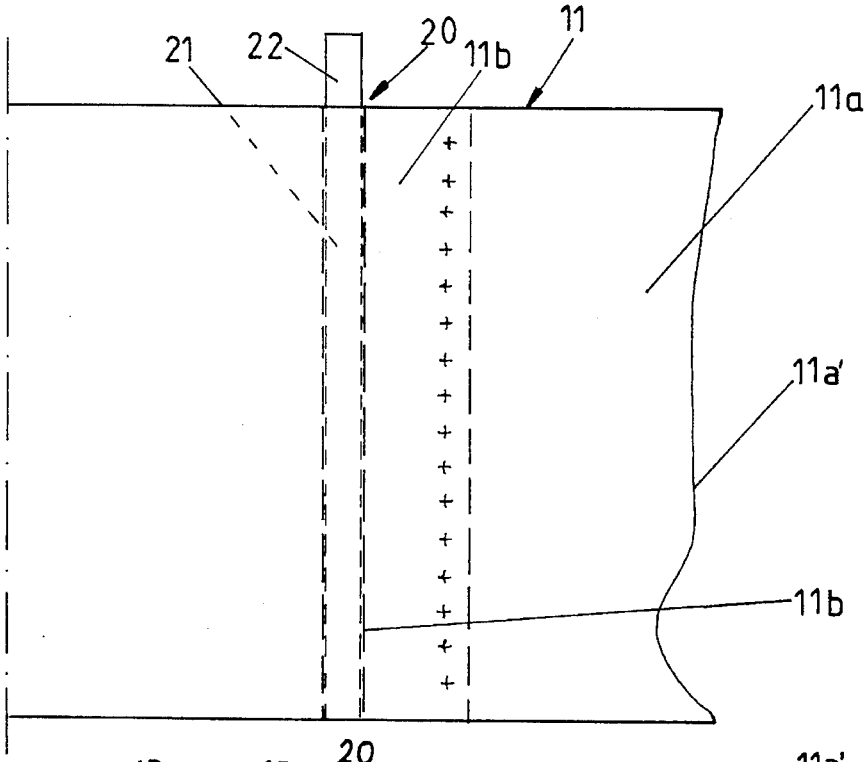
FIG. 3, in a view from above, shows the terminal area of the unrolled paper subsequent to the effected separation of the paper strip leader from the actual paper to be used.

The tearing tab 21 of the opening aid 20 is, with a gripping section 22, made to issue from the end 10*b* of the paper roll 10 (FIGS. 1, 2 and 3). This tearing tab 21 is disposed in or on the paper layer 13 of paper roll 10, which is covered by the external paper layer 14, whose free end 14*a* is glued together with the subjacent paper layer 13.

Furthermore, the paper roll 10 is provided with a paper strip leader 11 which follows the tearing tab 21 within the external terminal paper area 12, in which case said paper strip leader 11 forms the actual packaging envelope which is comprised of the same paper that is rolled up so as to form a roll.

In the embodiment illustrated in the FIGS. 3 to 6, the tearing tab 21 is attached to the internal wall area 13*b* of the paper layer 13 of the paper roll 10 which is covered by the paper layer 14, whose free end 14*a* is glued together with the subjacent paper layer 13, which is indicated with 15 in FIG.

Figure 6:
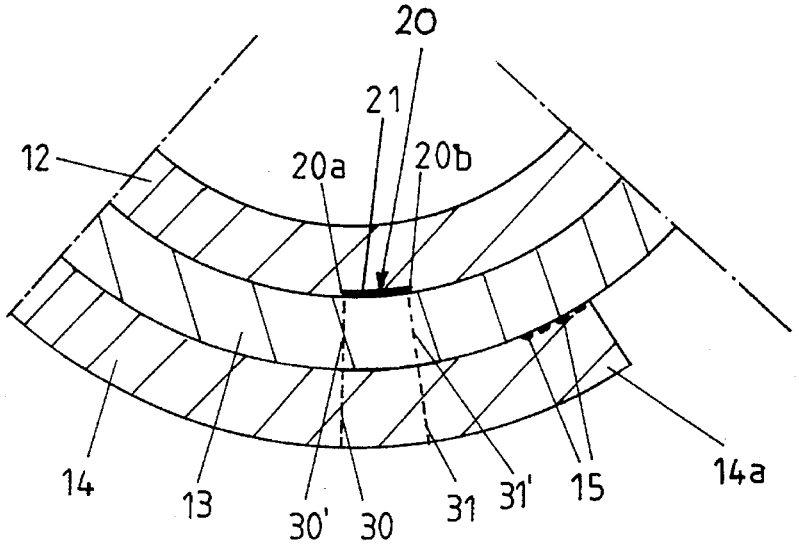
FIG. 6, in an enlarged horizontal section, shows the opening section of the paper roll comprising the aid.

6. By virtue of this construction, the tearing tab 21 is located between the paper layer 13 and the internal paper layer 12 following thereupon. The tearing tab 21 is attached to the internal wall area 13*b* of the paper layer 13 with the aid of an adhesive agent. In the outermost paper layer 14, which covers the paper layer 13 with the tearing tab 21 and whose free end 14*a* is glued together with the subjacent paper layer 13 at 15, are provided two separating rating perforations 30,31 proceeding parallel to each other in the longitudinal direction of the paper roll and which proceed above the lateral rims or edges 20*a*,20*b* of the tearing tab 21 and are aligned with the same (FIG. 6). In addition, the paper layer 13 bearing the tearing tab 21 of the paper roll 10 possesses two separating perforations 30',31' proceeding parallel to each other in the longitudinal direction of the paper roll, which are disposed so as to proceed on both sides of the tearing tab 21. The separating perforations 30,31 disposed in the external paper layer 14 covering the tearing tab 21, whose free end is glued together with the paper layer 13 located therebelow at 15, are aligned with the separating perforations 30',31', which are formed in the paper roll layer 13 which carries the tearing tab 21 so that, in the two paper roll layers 13 and 14 separating perforations 30,31 and 30',31' are formed which are in alignment with the lateral rims or edges 20*a*, 20*b* of the tearing tab 21 and which facilitate a separation of the paper strip leader 11, that is to say from the packaging envelope in so far as, when tearing the tearing tab 21 open or off in the direction of the arrow X, the paper layers 13,14 located above the tearing strip tab 21 and within the area of the same are severed. Since the gift wrapping, shelf-lining and book-binding papers happen to be fairly thin paper material, the separating perforations 30,31 and 30',31' merely represent separating aids, especially as a tearing open and tearing off of the tearing tab is also possible without the presence of separating perforations.

It is also possible to employ a tearing thread as an opening aid 20 in lieu of a tearing tab 21. The paper strip leader 11, which follows the opening aid 20 of the paper roll 10, preferably possesses a length which is greater than the circumference of the paper roll.

Figure 4:
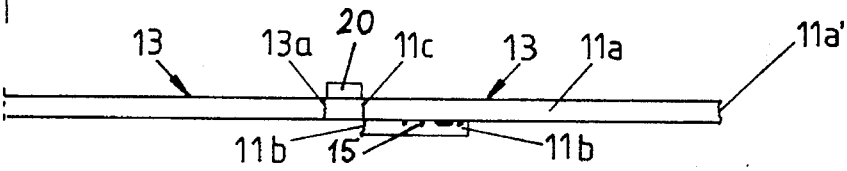
FIG. 4, the side, shows the terminal section of the unrolled paper corresponding to FIG. 3.
Figure 5:
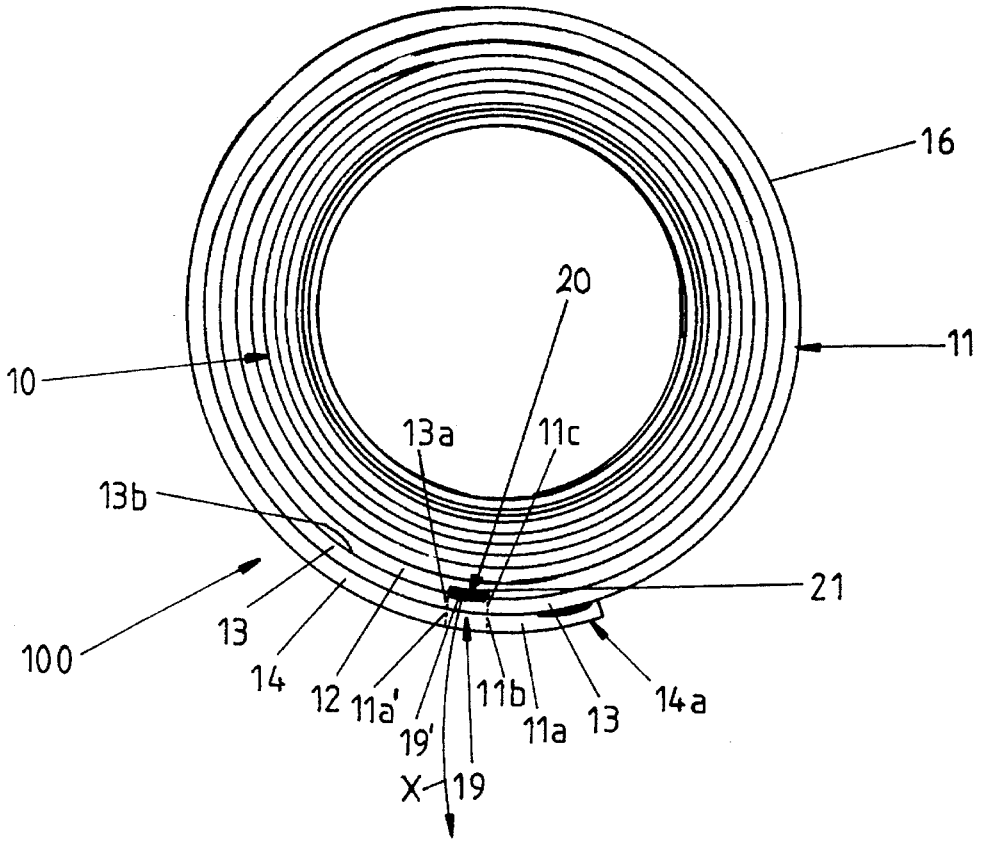
FIG. 5 shows an enlarged view of the one end of the paper roll.

A sales package 100 comprising a paper roll 10 with an opening aid 20 worked into the paper of the paper roll, by preference in the form of a tearing tab 21, is opened as follows: The tearing tab 21 is seized by its free gripping section 22 (FIG. 1) and pulled out of the paper in the longitudinal direction of the paper roll so that the paper strip leader 11 is obtained as packaging envelope. This paper strip leader 11 is formed by the section 11*a* and the narrower section 11*b* which, during the production of the paper roll 10, is glued onto the section 10*a*. If the tearing tab 21 is pulled off, tearing or separating edges 11' and 11*b'* are then obtained in the external paper layer 14 on both sides of the separating area. Tearing or separating edges 13*a* and 11*c* are obtained in the same way in the paper layer 13, in which case the tearing and separating edge 11*a'* then constitutes the beginning of the paper to be actually used. Due to the circumstance that the paper section 11*b* of the paper strip leader 11 is glued onto the paper section 11*a*, after the tearing off of the tearing tab 21, the paper strip leader 11 with the tearing and separating edges 11*b'* and 11*c* are obtained (FIGS. 3, 4 and 5). If the sales package 100 has not been broken open yet, then the paper strip leader 11o with its edge 11*a'*, is connected with the edge 11*b'* by means of the paper web 19 (FIG. 5). When tearing open the tearing tab 21, in the two paper layers 13,14, the paper webs 19 and 19' are torn off along with the same, in which case the width of these paper webs 19,19' corresponds to the width of the tearing tab 21.

According to a further embodiment, the opening aid 20 may be comprised of a separating perforation, which can also be constructed in the form of a double separating perforation, in which case, between the two separating lines proceeding at a distance from each other, a strip-shaped web is formed, which serves for opening the fastening means formed, which is obtained by the connection of the free end 14*a* of the external paper layer 14 with the subjacent paper layer 13. The possibility also exists of the free end 14*a* of the external paper layer 14 being glued together with the subjacent paper layer 13 with the aid of a readily soluble adhesive agent. By preference, an impact adhesive is used as adhesive agent, by virtue of which the free end 14*a* of the external paper layer 14 is retained on the subjacent paper layer 13 by means of a low adhesiveness in such a way that a residue-free detachment of the free end 14*a* is possible. Such impact adhesives are described in the DE U.S. Pat. Nos. 2,407,494, 3,691,140, 2,417,312, 2,510,120 and 2,535,897.

It is possible, moreover, for the free end 14*a* of the external paper layer 14 to be retained on the subjacent paper layer 13 with the aid of an adhesively affixed label 40, which is expediently constructed so as to be self-adhesive.

I claim:

1. A combined packing a paper roll, wherein the paper roll comprises an outermost paper layer having a free end, a subjacent paper layer underneath the outermost paper layer, an adhesive connection between the free end of the outermost paper layer and the subjacent paper layer, an opening aid provided at a radially inwardly facing surface of the subjacent paper layer, the opening aid being adapted for tearing through the outermost paper layer and the subjacent paper layer, wherein the outermost paper layer and the subjacent paper layer extending between the opening aid and the free end of the outermost paper layer form a paper strip leader serving as the packing for the paper roll.

2. The combined packing and a paper roll according to claim 1, wherein the opening aid has lateral edges, and wherein the outermost paper layer has two separating perforations extending parallel to one another in a longitudinal direction of the paper roll, the two separating perforations being provided above the lateral edges of the opening aid and in alignment with the lateral edges of the opening aid.

3. The combined packing and a paper roll according to claim 2, wherein the subjacent paper layer has two separating perforations extending parallel to one another in the longitudinal direction of the paper roll, and wherein the two separating perforations of the subjacent paper layer are arranged in alignment with the two separating perforations of the outermost paper layer.

4. The combined packing and a paper roll according to claim 1, wherein the adhesive connection between the free end of the outermost paper layer and the subjacent paper layer comprises a readily releasable adhesive agent.

5. The combined packing and a paper roll according to claim 4, wherein the adhesive agent is an impact adhesive, whereby the free end of the outermost paper layer is retained on the subjacent paper layer with low adhesiveness, the free end can be detached without leaving residue and can be reattached to the subjacent paper layer.

6. The combined packing and a paper roll according to claim 1, wherein the opening aid is comprised of a separating perforation.

7. The combined packing and a paper roll according to claim 1, wherein the opening aid is comprised of a tearing tab or a tearing thread.

8. The combined packing and a paper roll according to claim 7, wherein the paper roll has ends, the opening aid comprised of the tearing tab or tearing thread extending out of the paper roll at one of the ends of the paper roll, wherein a portion of the opening aid extending out of the paper roll forms a gripping section.

9. The combined packing and a paper roll according to claim 1, wherein the opening aid is comprised of a strip-like blank of a tear-proof material.

10. The combined packing and a paper roll according to claim 9, wherein the tear-proof material is cardboard or pasteboard.

11. The combined packing and a paper roll according to claim 1, wherein the paper strip leader has a length which is greater than a circumference of the paper roll.

12. The combined packing and a paper roll according to claim 1, wherein the adhesive connection between the free end of the outermost paper layer and the subjacent paper layer is an adhesively affixed label.

* * * * *